United States Patent [19]

Coffman

[11] 4,299,525

[45] Nov. 10, 1981

[54] LUG LOADER

[76] Inventor: Robert G. Coffman, Rte. 3, Box 415-C, Gate City, Va. 24251

[21] Appl. No.: 146,059

[22] Filed: May 2, 1980

[51] Int. Cl.[3] ..... F27D 3/04

[52] U.S. Cl. ..... 414/181

[58] Field of Search ..... 294/17, 9, 10, 11, 103 R, 294/87 R; 414/184, 186, 542, 910, 173, 180–183, 198; 212/217; 126/190, 218

[56] References Cited

U.S. PATENT DOCUMENTS

| | | | |
|---|---|---|---|
| 1,253,996 | 1/1918 | Turk . | |
| 2,928,560 | 3/1960 | Wilkin | 414/542 |
| 4,186,839 | 2/1980 | Majors | 294/11 |

FOREIGN PATENT DOCUMENTS

| | | | |
|---|---|---|---|
| 620675 | 4/1927 | France | 126/190 |

*Primary Examiner*—James B. Marbert

[57] ABSTRACT

A tool is described for assisting in the endwise insertion of logs into a wood-burning stove. The tool includes a cradle in supporting a major portion of a log, the cradle being of a size to pass through the door opening of the stove. A handle extends from the rear of the cradle to permit a user to orient the frame, within the stove, for proper placement of the log. The handle may be provided with an ejector which is used to push the log from the cradle when desired. A handle extension, pivoted to the end of the handle, is provided to contact the floor and support the handle end of the tool while a log is placed on the cradle, the forward end of the cradle resting on a support at the door opening. This support may be a horizontal roller mounted at the stove door opening.

7 Claims, 2 Drawing Figures

LUG LOADER

This invention relates generally to article handling equipment, and more particularly to a tool for the endwise loading of logs into a wood-burning stove.

As a result of the increased cost of conventional energy sources, such as oil, gas and electricity, there is an increased utilization of wood-burning stoves. One type of stove which is particularly useful for space heating is a stove which burns logs. The advantage of such a stove is that relatively large logs may be used as fuel so that the stove will burn over a long period of time without refueling. Many of the stoves that are employed to burn logs have an elongated firebox with the charging door on one end and the logs are inserted lengthwise to lie along the length of the firebox.

The fueling of an end loading stove causes a number of problems because of the configuration of the stove. For example, a log must be inserted into a firebox a distance at least equal to the length of the log. This makes it extremely difficult to place the log in the desired position on the burning coals because of the distance involved, the heat of the coals and the weight of the log. Many users toss the logs into the firebox. However, when this is done it is difficult to place the log in the desired position, the bed of coals is violently disturbed, and, if the log is thrown too hard, it may hit the opposite end of the firebox giving rise to potential damage to the stove. Further, it is very difficult to use tongs and/or a poker to position the log within the firebox since the door is relatively small and the center of gravity of the log is a substantial distance from the door.

Accordingly, it is the primary objection of this invention to provide a tool which can be used with end-loading wood stoves for the convenient, safe and accurate placing of logs in the firebox.

Figure 1:
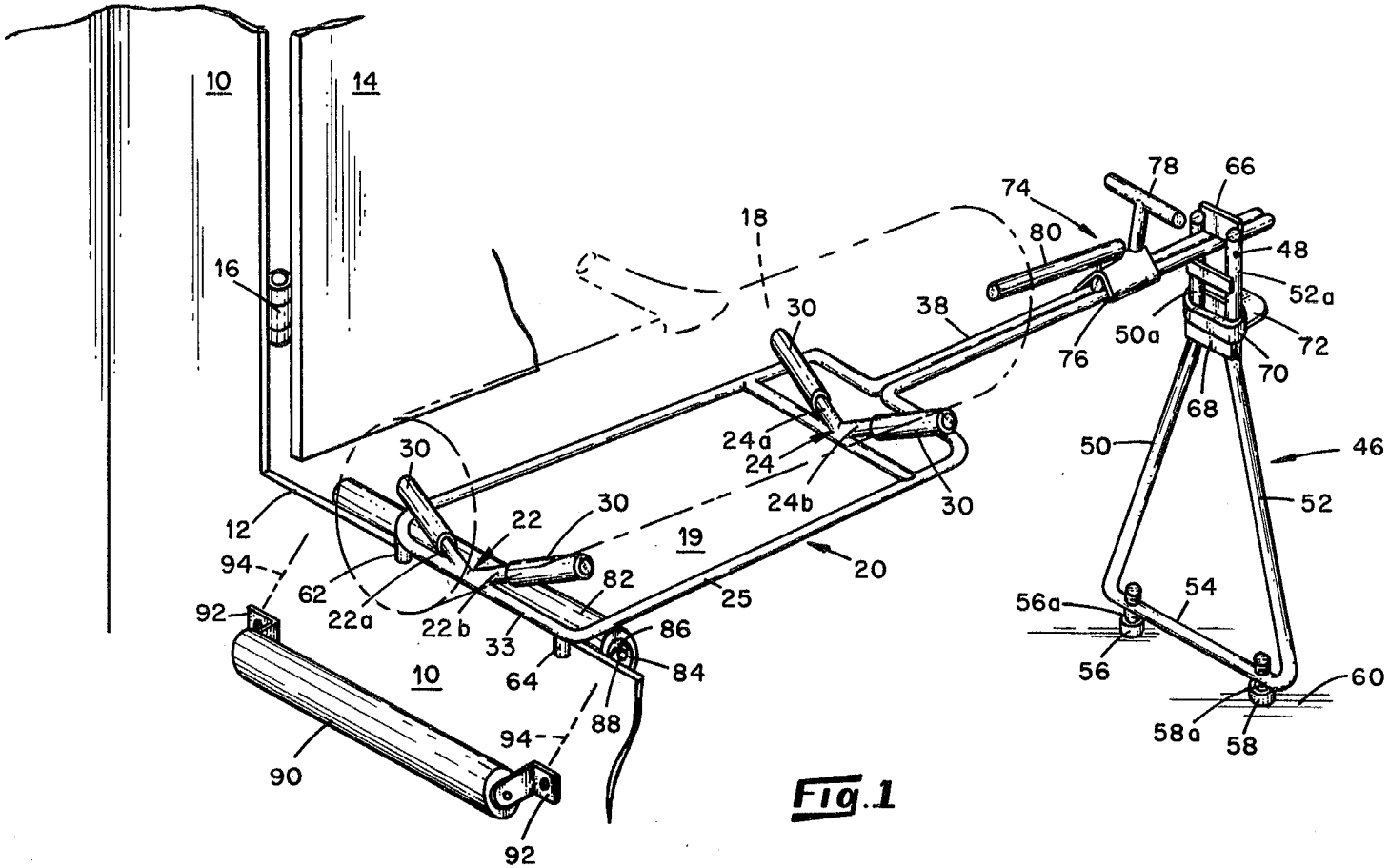
Figure 2:
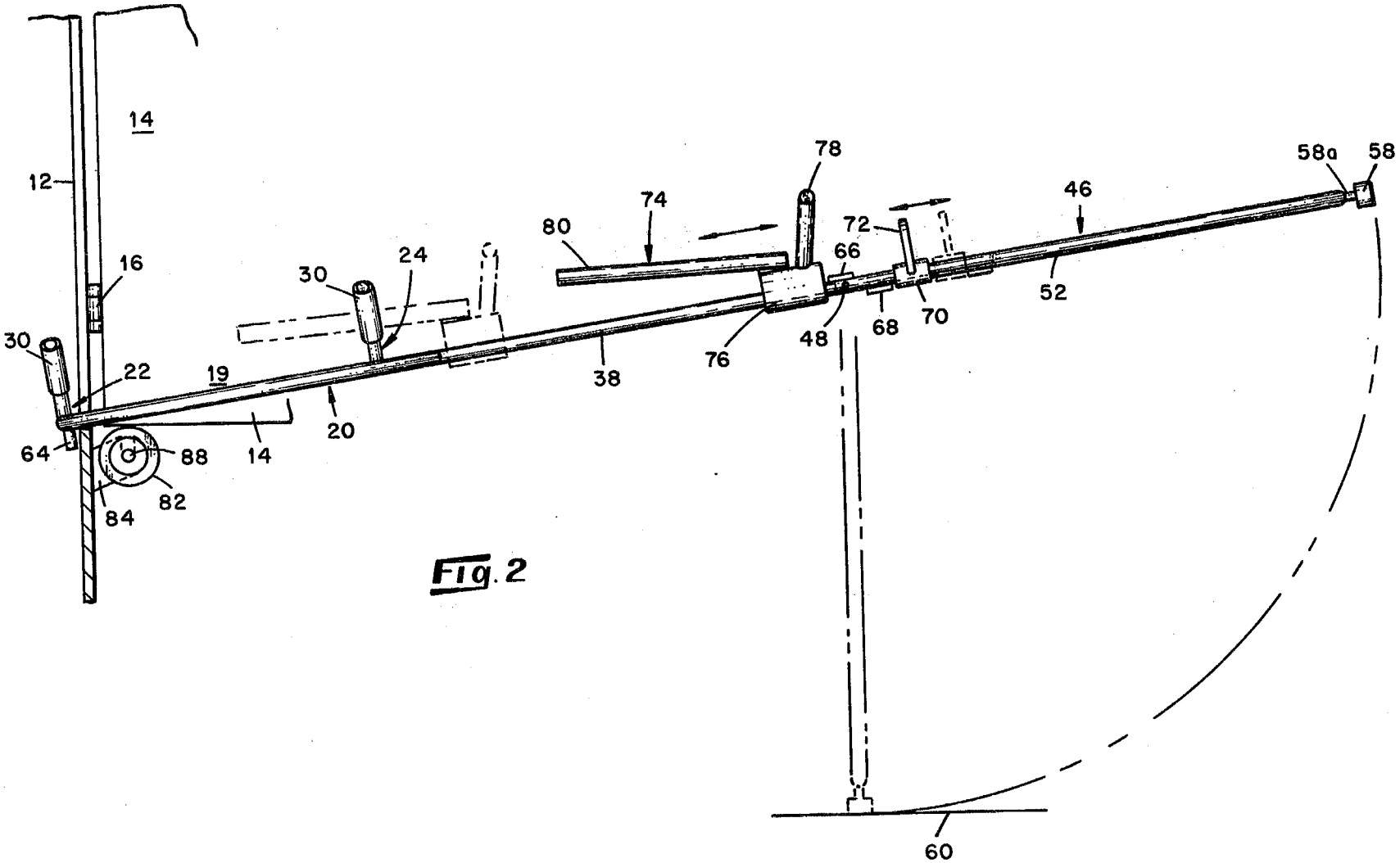

Other objects and advantages of the invention will become known by reference to the following description in the accompanying drawings in which:

FIG. 1 is of an isometric view of a log-loading tool for accomplishing various of the objects of the invention; and FIG. 2 is a side elevational view of the tool shown in FIG. 1 indicating positions of the movable portions of the tool.

In general, the illustrated embodiment of the invention includes means defining a cradle which is proportioned to support a major portion of the length of the log so that the center of gravity of the log lies over the cradle, the cradle being proportioned to move through the stove door opening. A handle extends rearwardly from the cradle so that the position of the cradle can be manipulated from the outside of the stove to the desired position within the firebox. When the log is disposed over the desired position, the log can be moved on the cradle by any suitable means to cause the center of gravity of the log to move off of the cradle. The cradle can then be withdrawn from under the log to deposit the log in the desired position.

The invention will be best understood by reference to the drawings. In FIG. 1 there is shown a fragmentary view of a wood-burning stove which includes an end wall 10 having a charging opening 12. A door 14 for closing the charging opening 12 is connected to the end wall 10 by, for example, hinges 16 (one of which is shown). It is through the opening 12 that a log 18 is to be inserted into the firebox in an endwise orientation.

The loading tool for the log 18 includes a cradle means 19 which comprises a support frame 20 for a pair of cradle members 22 and 24 which are adapted to support the log 18.

The illustrated frame 20 is fabricated from rods, tubes or the like 25, in a generally rectangular configuration. Mounted transversely on the frame 20 are the cradle members 22 and 24. Each of the cradle members 22 and 24 includes a pair of arms **22*a* and 22*b* and 24*a* and 24*b*, respectively. Each of the pairs of arms are arranged in a V-shape so that the log 18 will not roll off the cradle 19. In order to facilitate longitudinal movement of the log relative to the cradle each of the arms 22*a* and 22*b* and 24*a* and 24*b* is provided with a roller 30. Extending from the rearward end of the frame 20 is an elongated handle 38 which may be formed from the rod or tube 25 which forms the frame 20. The handle 38, as illustrated, is generally parallel to the axis of the log 18** to be loaded.

In order that the cradle may be positioned in the charging opening 12 of the stove for loading a log, a handle extension 46 is connected to the end of handle 38 by a pivot pin 48. The handle extension 46 illustrated, includes a pair of diverging legs 50 and 52 whose lower ends are interconnected by member 54. The upper ends **50*a* and 52*a* of the legs 50 and 52 are generally parallel, as illustrated, and are spaced apart to straddle the handle 38 to which they are pivotally attached by means of the horizontally disposed pin 48. In order that the cradle 19 can be maintained in a generally horizontal position for loading a log, adjustment feet 56 and 58 are provided on the member 54. The adjustment feet 56 and 58 include screw threads 56*a* and 58*a*, respectively, which permit the adjustment of the height of the rearward end of the handle 38 when the handle extension is in the vertical position and resting upon the floor 60**.

In order that the log loader does not fall from the charging opening 12, when it is in the position shown in FIG. 1, a pair of spaced apart, downward projecting lugs 62 and 64 are connected to the forward portion of the frame 20.

With the loader in the position shown in FIG. 1, the log 18 can be placed on the cradle 19 with its center of gravity lying between the two cradle members 22 and 24. In order to move the log into the stove, the handle extension is swung upwardly to the position shown in FIG. 2, in alignment with handle 38, and is locked in position. This is accomplished in the illustrated structure by providing a cross member 66 which is attached to one side of the upper ends **50*a* and 52*a* of the diverging legs 50 and 52 as illustrated so that as the handle extension 46 is rotated, the bar cross member 66 engages the upper surface of the handle 38. On the side of the legs 50 and 52, opposite that to which is attached the member 66 and below the pivot point 48 there is also attached cross member 68 which engages the lower side of the handle 38, thus insuring that the extension 46 does not rotate further than to an in-line position with the handle 38. The handle and handle extension are locked together by a locking means which includes a sliding ring 70 which extends around the upper ends 50*a* and 52*a* of the diverging legs 50 and 52 and which captures the rearward end of the handle 38. In order that the user's fingers are not pinched by the action of the ring 70 it is provided with a protecting flange 72**.

With the handle extension 46 in its uppermost position and locked, the tool is then slid into the firebox on the bottom of the charging opening 12 to position the log in the desired place in the firebox. When it is in the proper place, the end of the log is pushed forwardly along the cradles 22 and 24 to a point where its center of gravity causes its innermost end to tip down into the firebox. At this point, the tool can be withdrawn with the rollers 30 permiting easy withdrawal with the tool from under the log.

The log can be pushed from the cradle 19 by means of a poker or the like. However, it is desirable to provide an ejecting means which constitutes a part of the tool. In the illustrated device, an ejector means 74 is provided. The ejector means 74 includes a yoke 76 which is slidably supported for longitudinal movement on the elongated handle 38. A handle 78 for the ejector means 74 is connected to the yoke 76. The handle 78 in the illustrated device is T-shaped and is adapted to be grasped by the user. In order to engage the log, an ejector pin 80 is provided, one end of which is connected to the yoke 76 and the other end of which terminates at a position which will firmly engage the end of a log on the cradle. Thus, in operation, the log can readily be ejected by pushing on the handle 78 which will move the log into a position where its center of gravity is moved off of the cradle 19.

In order to facilitate use of the tool it is desirable that a roller be provided adjacent the stove opening. This can be accomplished in one of two ways. First, a roller 82 can be supported along the bottom of the charging opening on a pair of brackets 84. At least one of the brackets 84 is provided with a slot 86 which will receive the supporting rod 88 for the roller 82. Thus, the roller 88 can be readily removed from the opening in order to permit closing of the fire door.

In the alternative, a permanent roller may be attached to the inner side of the end wall of the stove. Such a roller 90 is shown as an alternate in FIG. 1. The roller 90 is supported on brackets 92 which may be attached to the innerface fo the furnace wall as shown by the dotted lines 94 in FIG. 1.

In operation, the door 14 is opened and the cradle 19 is placed upon the roller in the door opening. The handle extension is moved into a vertical position to engage the floor 60 and the log is placed on the cradle. The handle extension is then raised into an aligned position with the handle 38 and is locked in position by the locking means 70. The tool is then rolled into the stove to the desired position whereupon the log is pushed over the end of cradle 19 by means of the ejector 74, and the tool is withdrawn from under the log to place the log in the desired position.

While a preferred embodiment has been shown and described, it will be understood that there is no intent to limit the invention by such disclosure, but rather, it is intended to cover all modifications and alternate constructions falling within the spirit and scope of the invention as defined in the appended claims.

What is claimed is:

1. A tool for inserting logs through a door opening of a wood-burning stove which comprises means defining a cradle including at least one pair of arms arranged in a V-shape and proportioned to support at least the major portion of the length of a log, an elongated handle attached to said cradle, said cradle being generally parallel to the longitudinal axis of the log to be supported, an extension for said elongated handle, said extension being pivotally attached to said elongated handle for movement from a position in alignment with said elongated handle to a position generally perpendicular to said handle whereby said cradle may be supported on the door opening of the stove in a generally horizontal position when said handle extension is in the perpendicular position for placing a log on said cradle and said cradle may be moved into said stove when said handle extension is in the aligned position with said elongated handle.

2. The tool of claim 1 wherein the cradle is provided with a plurality of rollers for supporting the log for longitudinal movement relative to the cradle.

3. The tool of claim 1 wherein a locking means is provided which prevents pivotal movement between said elongated handle and said handle extension when said handle extension is in alignment with said elongated handle.

4. The tool of claim 1 wherein a yoke is slidably supported on said elongated handle, said yoke carrying a member to engage said log and said yoke being provided with means defining a handle for effecting movement of said yoke longitudinally of said elongated handle.

5. Means for inserting logs through a door opening in a wall of a wood-burning stove which comprises a horizontally disposed roller, means for attaching said roller to the wall of said stove in a position along the bottom of said door opening, means defining a cradle proportioned to support at least the major portion of the length of a log, an elongated handle attached to said cradle, said cradle being generally parallel to the longitudinal axis of the log to be supported, an extension for said elongated handle, said extension being pivotally attached to said elongated handle for movement from a position in alignment in said elongated handle to a position generally perpendicular to said handle whereby said cradle may be supported on said horizontally disposed roller in a generally horizontal position when said handle extension is in the perpendicular position for placing a log on said cradle and said cradle may be moved into said stove on said horizontally disposed roller when said handle extension is in the aligned position with said elongated handle.

6. A tool for inserting logs through a door opening of a wood-burning stove which comprises means defining a cradle proportioned to support at least the major portion of the length of a log, an elongated handle attached to said cradle, said cradle being generally parallel to the longitudinal axis of the log to be supported, lugs on said cradle to engage the door opening of the stove and a plurality of rollers for supporting the log for longitudinal movement relative to the cradle.

7. The tool of claim 6 wherein a yoke is slidably supported on said elongated handle, said yoke carrying a member to engage said log and said yoke being provided with means defining a handle for effecting movement of said yoke longitudinally of said elongated handle.

* * * * *